US009382048B2

(12) United States Patent
Van De Klippe et al.

(10) Patent No.: US 9,382,048 B2
(45) Date of Patent: Jul. 5, 2016

(54) CLOSURE BAND FOR CONTAINERS

(71) Applicant: GREIF INTERNATIONAL HOLDING BV, Vreeland (NL)

(72) Inventors: Cornelis Van De Klippe, West Chicago, IL (US); Kevin Micallef, New South Wales (AU); Dale Taylor, Carol Stream, IL (US)

(73) Assignee: Greif International Holding BV, Vreeland (NL)

( * ) Notice: Subject to any disclaimer, the term of this patent is extended or adjusted under 35 U.S.C. 154(b) by 0 days.

(21) Appl. No.: 14/355,828

(22) PCT Filed: Nov. 2, 2012

(86) PCT No.: PCT/EP2012/071743

§ 371 (c)(1),
(2) Date: May 1, 2014

(87) PCT Pub. No.: WO2013/064649

PCT Pub. Date: May 10, 2013

(65) Prior Publication Data

US 2014/0299569 A1 Oct. 9, 2014

Related U.S. Application Data

(60) Provisional application No. 61/556,013, filed on Nov. 4, 2011.

(51) Int. Cl.

| | |
|---|---|
| ***B65D 47/36*** | (2006.01) |
| ***B65D 45/32*** | (2006.01) |
| ***B65D 47/06*** | (2006.01) |

(52) U.S. Cl.

CPC ..... *B65D 45/322* (2013.01); *B65D 45/32* (2013.01); *B65D 47/063* (2013.01); *B65D 2101/00* (2013.01); *Y10T 24/1498* (2015.01)

(58) Field of Classification Search

CPC .... B65D 47/063; B65D 55/022; B65D 45/32; B65D 45/322; B65D 2101/00; B65D 45/345; Y10T 24/1498

USPC ..... 220/319–321; 292/256, DIG. 11; 24/16 PB; 215/274, 275

See application file for complete search history.

(56) References Cited

U.S. PATENT DOCUMENTS 1,912,179 A 5/1933 Cornell (Continued)

FOREIGN PATENT DOCUMENTS

| | | |
|---|---|---|
| EP | 0320808 A1 | 6/1989 |
| FR | 671321 A | 12/1929 |

(Continued)

*Primary Examiner* — Fenn Mathew
*Assistant Examiner* — James N Smalley
(74) *Attorney, Agent, or Firm* — Baker & Hostetler LLP

(57) ABSTRACT

A retaining band is provided for a container, e.g. for a joint between a flexible plastics pouring spout and a container neck, or for a lidded drum or pail. The band is movable from an expanded position in which it can be placed over the container with a clearance fit, to a constricted position in which the band tightly engages about the container. The band comprises a detent formed by a toothed spigot lockingly receivable in a toothed receptacle that are mechanically interengageable to prevent movement of the band from the constricted position towards the expanded position. The band may be formed as a separate component or as an integral part of a closure, the spout or the container.

17 Claims, 11 Drawing Sheets

(56) References Cited

U.S. PATENT DOCUMENTS

| | | | | |
|---|---|---|---|---|
| 3,973,293 | A * | 8/1976 | Noorily | 24/16 PB |
| 5,788,100 | A | 8/1998 | Sturk | |
| 5,797,525 | A | 8/1998 | McLelland et al. | |
| 2011/0197398 | A1 * | 8/2011 | Clorley | 24/16 PB |

FOREIGN PATENT DOCUMENTS

| | | | |
|---|---|---|---|
| FR | 2908393 | A1 | 5/2008 |
| FR | 2908394 | A1 | 5/2008 |
| WO | 2008071858 | A1 | 6/2008 |
| WO | 2008074934 | A2 | 6/2008 |

* cited by examiner

Fig. 1
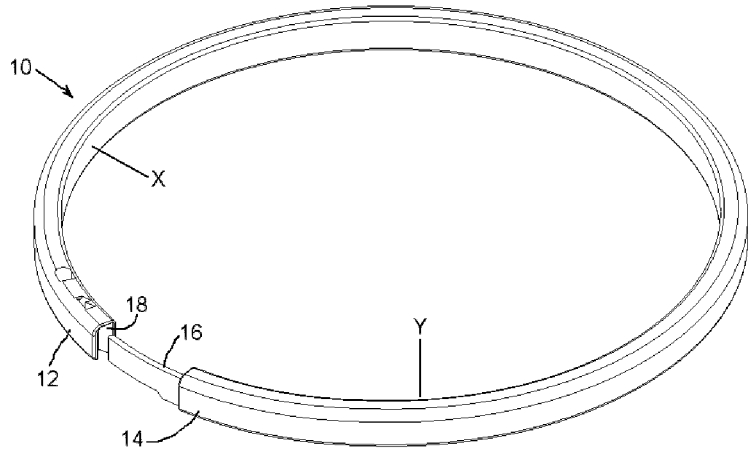
Fig. 2
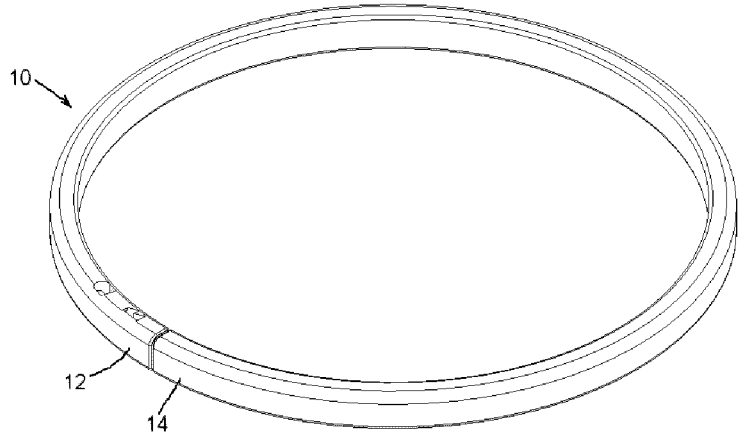
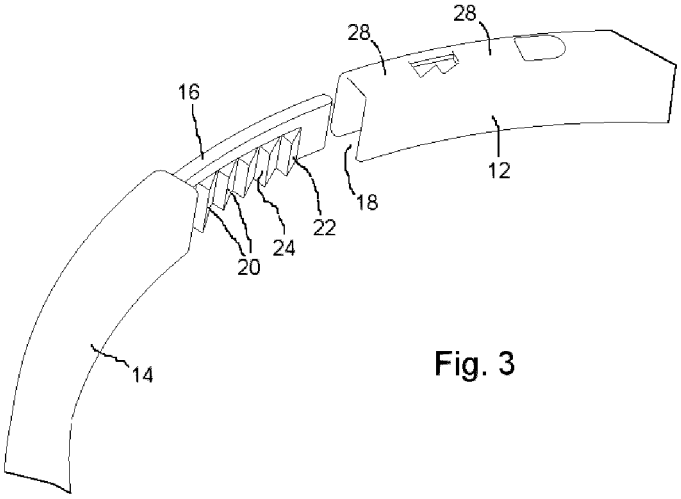
Fig. 3

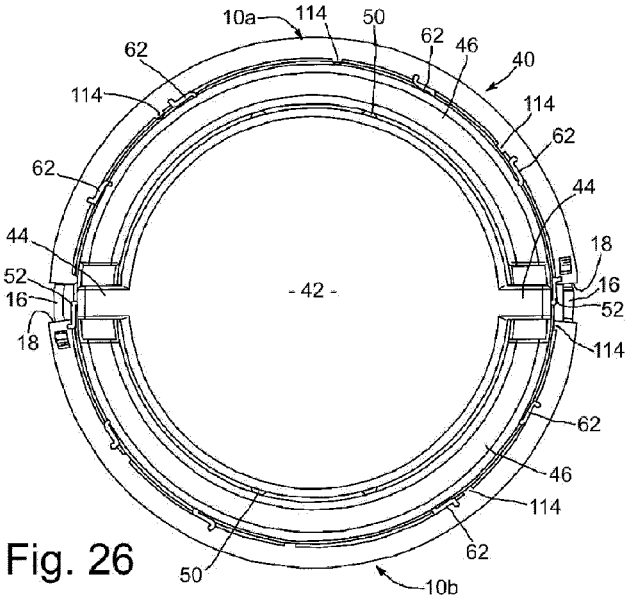
Fig. 26
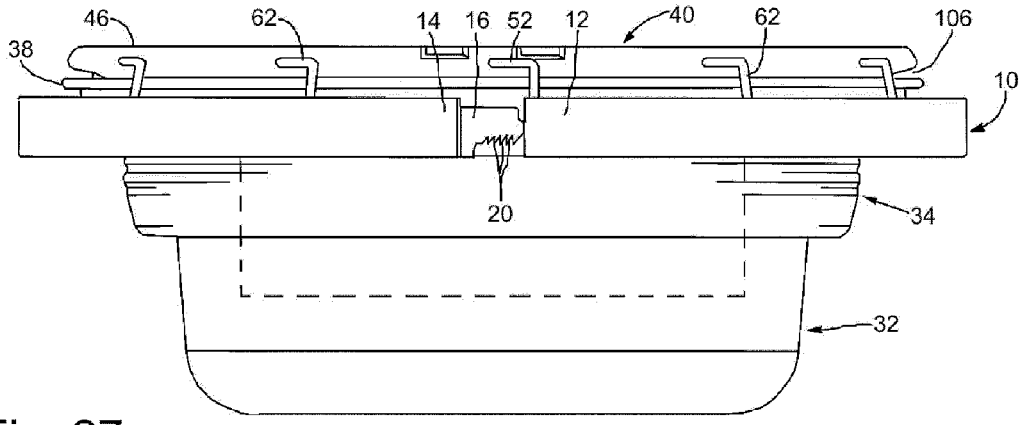
Fig. 27
Fig. 28
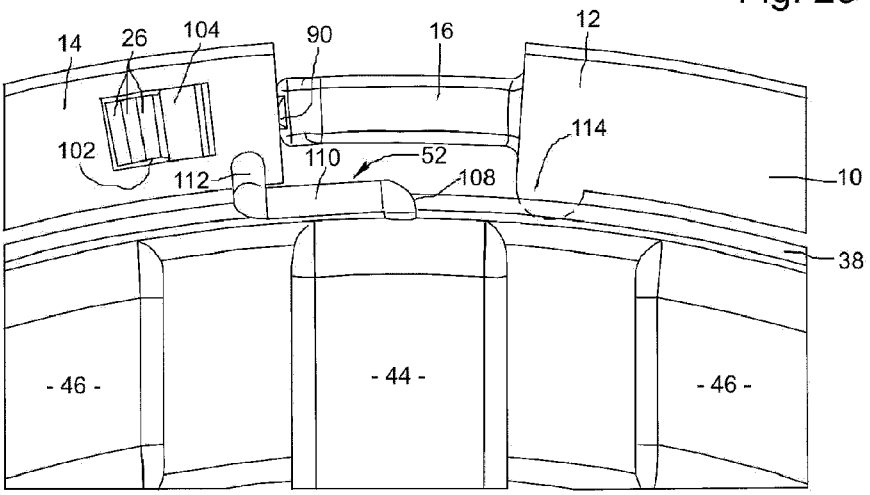

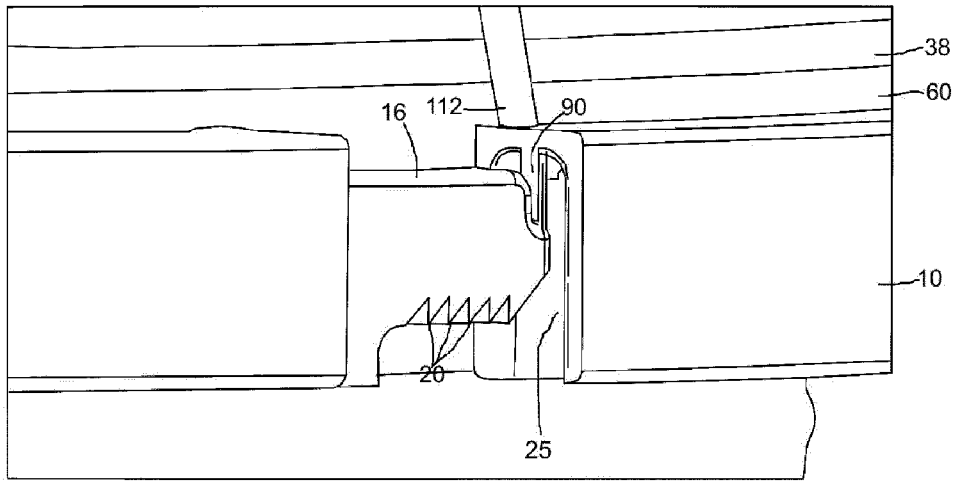
Fig. 29
Fig. 30
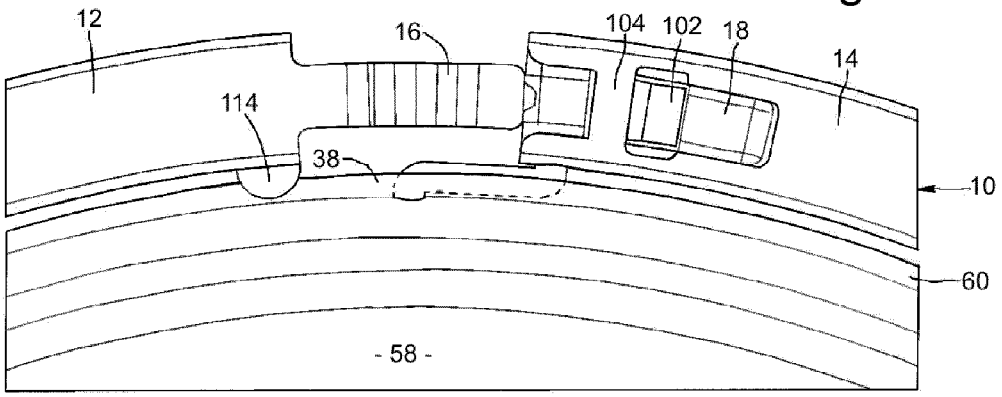
Fig. 31
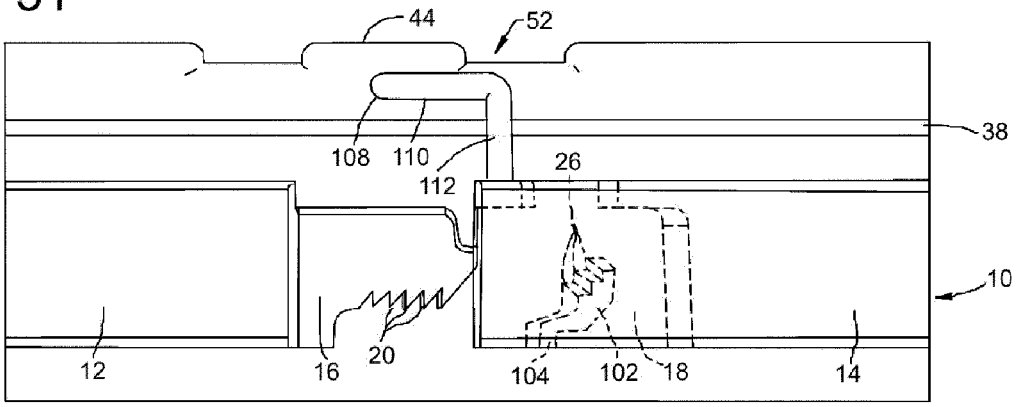

CLOSURE BAND FOR CONTAINERS

FIELD OF THE INVENTION

This invention concerns crimp rings inter alia for containers of the kind provided with a pouring spout formed from flexible plastics or similar materials, the spout typically being extendible for convenient dispensing of the container contents, but collapsible to nest within the container for convenient storage and protection at other times. However, the invention also has more general applicability in the field of packaging containers, e.g. even in relation to screw caps/plugs without a flexible plastics pouring spout, or pails and drums with removable lids.

BACKGROUND OF THE INVENTION

In containers with collapsible pouring spouts, the container is usually made from a relatively stiff material, such as sheet metal or HDPE, and the spout from a softer material, such as LDPE. The spout therefore has to be joined to the container in a reliably strong and preferably leak-proof way. Here the flexibility of the spout leads to difficulties, since those parts of it forming a joint with the container are easily deformed and so can be dislodged from the container, unless special measures are taken. Similarly, the flexibility of the spout material means that it is difficult to obtain a tight interference fit and a reliably energised seal at the spout/container joint. A known solution to this problem is to provide an end portion of the spout which peripherally overlaps a neck of the container, and a metal ring crimpable around the outside of the overlap so as to form a firm mechanical joint and energised fluid seal. Often the container neck will have an outwardly projecting circumferential rib or the like, and the joint-forming part of the spout a complementary inwardly projecting rib or the like, received beneath the neck rib and locked in engagement with it by the crimped ring. The resulting joints are satisfactory but use of a separate metal ring adds to expense and parts inventories, as well as making recycling more difficult. Metal rings can also be prone to corrosion. It is not readily possible to make such a crimpable ring from plastics material instead of metal, due to the differing elastic properties and yield point of plastics compared to the metals which are commonly used to form the crimpable ring, e.g. steel. Metal constrictable rings are also known for securing removable lids to pails and drums.

All-plastics closures for containers with flexible plastics spouts are known, in which the crimpable metal ring is replaced by a plastics ring or band, which is configured to snap-fit onto the container neck as an assembly with the joint-forming part of the spout. When so fitted, the plastics ring acts to force the end of the flexible spout into tight engagement with the container neck. The ring or band may comprise an outer circumferential part of the closure, made in one piece with a central part which forms a closure fitted to the tip of the spout, e.g. by a screw threaded connection. The central closure part can be pulled out from the outer circumferential part so as to extend the spout, then allowing the central part to be unscrewed or otherwise removed from the tip of the spout so that the container contents can be dispensed. The outer circumferential and central parts are typically joined by frangible links. The central part will often be provided with one or more bail-type handles, which can be raised and gripped to aid the central part pull-out and unscrewing etc. operations; the frangible links extending between the bail-type handles and the outer circumferential part. Such a container closure is disclosed for example in EP0320808, in which the outer circumferential part is forced axially downward relative to the central part during fitment of the closure and spout assembly to the container. This breaks the frangible links, which therefore cannot provide tamper indication.

Alternatively it is known to provide an outer circumferential part which does not move relative to the central part during installation of the closure and spout assembly on the container. Frangible links between the bails and the outer circumferential part therefore can remain intact during fitment of the assembly, as disclosed for example in U.S. Pat. No. 5,797,525. These links are broken when the bails are raised to pull out the spout and unscrew the closure central part, providing a degree of anti-tamper security. However it is still possible to "pop off" the entire cap/spout assembly from its snap-fit connection at the container neck, without breaking the frangible links.

A further problem is that the range of elastic deformation over which such a snap-engageable ring will provide satisfactory holding and energising force to the spout/neck joint is quite limited. Blow-moulded containers often exhibit large variations in their neck dimensions and container necks of a nominally standard size made by different manufacturers using different equipment can in fact also vary considerably in their critical dimensions, so that snap-fit all-plastics spout closure and joint constraint rings as described above will not perform satisfactorily for all the containers of a nominally identical neck size.

Such snap-fit closures also rely to some extent on the deformation of the container neck for ease of fitment. Metal container necks formed e.g. in pail lids and drum ends are relatively stiff, and this can lead to difficulties in applying the snap-fit closures, particularly if the container necks concerned are somewhat oversized. A more versatile and easier to fit plastics stabilising/enegising band for a spout/container joint or lid/container joint is therefore desirable.

A plastics overseal for a drum closure plug is known which comprises a disc-like or short cylindrical housing having an inwardly projecting peripheral flange at its lower end, by which the overseal is secured around a closure plug having an outwardly projecting peripheral flange. The overseal is axially divided along a diameter into two halves, connected at one end of the divide along an axial web-type hinge. Snap-fittingly interengageable fastener parts are provided on the overseal side wall at the other end of the divide opposite to the hinge, so that the overseal can be opened up to fit over the plug and then closed and secured with its inwardly projecting flange trapped beneath the plug flange. The overseal is not constrictable about the plug, but is instead a relatively loose fit.

Cable ties are also known which can be used to hold cables or the like in bundles, but these ties are not used, nor are they suitable for use, in container/spout joints. For example their fastening means are relatively bulky, making them difficult or impossible to fit around a recessed spout/container joint. They also lack security, and can be opened using a screwdriver or the like, without damage and hence without tamper indication.

SUMMARY OF THE INVENTION

The present invention accordingly provides a retaining band mountable on a container, and having the features defined in the characterising portion of claim 1.

The container may comprise, for example, a pouring spout and a container neck, but the retaining band of the invention has wider uses, e.g. for securing a closure or removable lid to a drum, pail or similar container, or for securing a plug or screw cap to a container. For use in securing drum and pail lids the band may have a recessed (e.g. V- or U-shaped) cross-sectional profile.

With the detent parts interengaged, the band may stabilise a joint between container parts, e.g. to hold a pouring spout in firm mechanical engagement with a container. This mechanical interengagement means that the material properties (e.g. elasticity and yield point) of the band need not be relied upon in order to ensure that the band is crimpable about the spout joint. The band may therefore be made of a wider range of materials besides metals, e.g. plastics. An all-plastics closure and pouring spout assembly thus made possible is more corrosion resistant and more easily recycled than an assembly including a metal crimp ring.

Additionally or alternatively when the detent parts are interengaged the band may act to energise a seal between the container components, e.g. a seal provided by the flexible material of a collapsible pouring spout, or an o-ring type seal in a lidded drum or pail. Both the interengageable parts and the remainder of the band may be formed from plastics material, e.g. as a one-piece injection moulding, for economy and ease of manufacture, fitment and recycling. The band may be formed as a separate component, or as part of a closure applied to the spout and/or the container, or as a part of the spout or container.

Preferably, the interengageable parts have to be destroyed or visibly damaged in order to permit removal of the fully fitted band from the container. This provides tamper indication. The interengageable parts may take any suitable form, e.g. one or more radially movable segments engageable about the container. Advantageously however, the interengageable parts comprise co-operating ends of the retaining band. The detent may serve to lock one of the ends to the other. The detent may comprise a spigot which is receivable in a receptacle, one of the spigot and receptacle being attached to an end of the band, and the other of the spigot and receptacle being attached to another end of the band. The detent may comprise a ratchet, e.g. comprising co-operating teeth. The tooth or teeth on the spigot preferably lie inwardly towards the container in use, so that they are protected by the receptacle and container against any attempt to disengage them from the receptacle tooth or teeth. Alternatively, the co-operating teeth lie towards the upper or lower circumferential surfaces of the retaining band, so that the crimping forces do not interfere with movement of the teeth past one another during application of the band. When the band is fastened and crimped tightly around the container, it is difficult if not impossible to insert an implement such as a screwdriver into the receptacle to prise the inerengaged teeth apart.

A closure comprising the band may have a central part mountable on a pouring spout to close the spout. The closure may comprise one or more bail handles attached to the central part. The, all or some of the bail handle(s) or another part of the closure otherwise separate from the central part may be attached to the central part by a frangible connection, so as to provide further tamper indication. The central part and/or bail handles may be connected to the band by a frangible connection for similar reasons, and/or to prevent the central part from "popping up" as a result of fluid pressure in the container. The frangible connection(s) can be broken and is/are preferably hidden from view on interengagement of the detent parts. Alternatively the frangible connections may comprise flexible links which allow extension movement between the band and the remainder of the closure, sufficient for crimping of the band during fitment of the closure.

The invention and some of its preferred features and advantages are further described below with reference to illustrative embodiments shown in the drawings.

BRIEF DESCRIPTION OF THE DRAWINGS

FIG. 1 is a perspective view of a joint stabilising band in accordance with an embodiment of the invention, prior to interengagement of the parts;

FIG. 2 shows the band of FIG. 1 crimped and with its end parts lockingly interenggaged;

FIGS. 3 and 4 are perspective views of the band spigot and receptacle of the band from FIG. 1, shown from above and below respectively, prior to interengagement of the band end parts;

FIG. 26 is a top plan view of a yet further embodiment of a cap and stabilising band of the invention;

FIG. 27 is a side view of the cap and band of FIG. 26;

FIG. 28 is an enlarged view of a portion of FIG. 26;

FIG. 29 is an enlarged perspective view of a tongue and receptacle which form part of the stabilising band shown in FIGS. 26 and 27;

FIG. 30 shows details of the tongue and receptacle of FIG. 29 viewed from below;

FIG. 31 corresponds generally to FIG. 29, but shows details of a retainer pawl;

DETAILED DESCRIPTION

Figure 4:
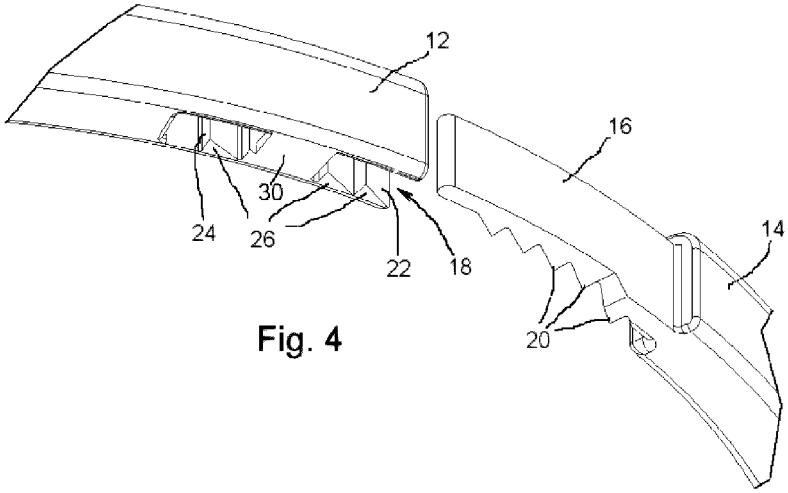
Figure 5:
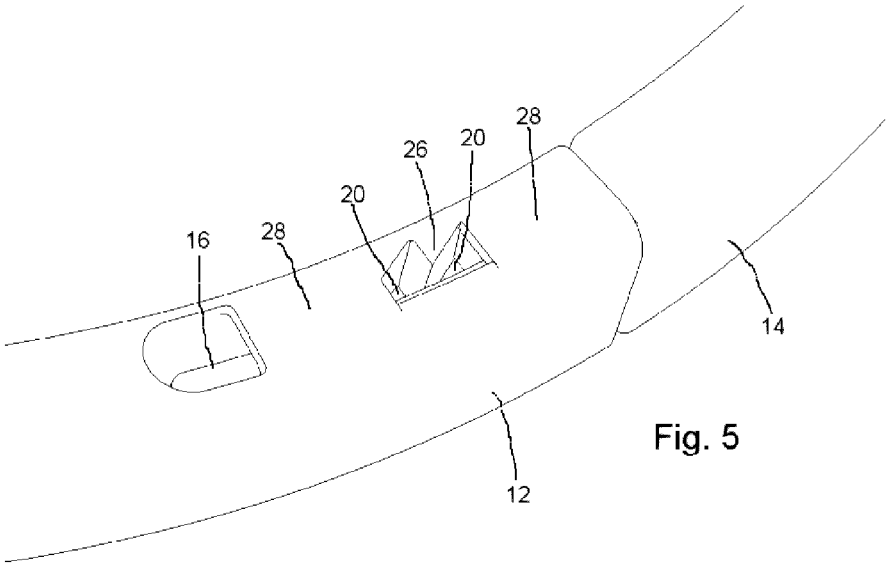
FIGS. 5 and 6 are perspective views of the interengaged band ends of the band from FIG. 1 from above and below respectively.
Figure 6:
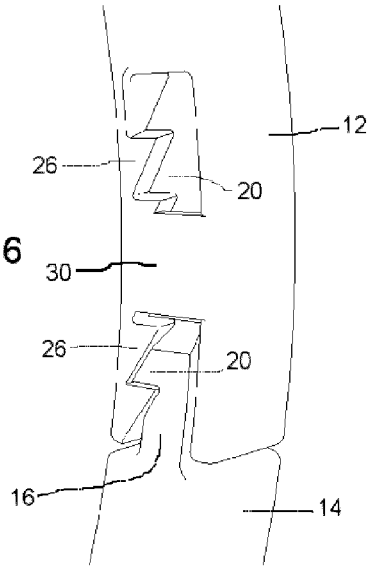
Figure 7:
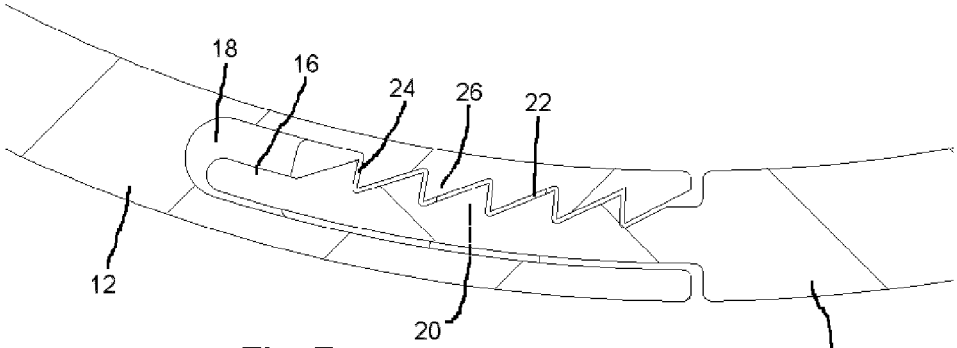
FIG. 7 is a horizontal cross-section through the interengaged band ends of the band from FIG. 1.

The band 10 shown in FIG. 1 is generally ring shaped but has an open condition in which it is interrupted to form a pair of ends 12, 14. The band may be used to stabilise a joint between a container and a flexible pouring spout as further described below. The band 10 is conveniently injection moulded from a tough plastics material such as HDPE, nylon or ABS. End 14 is formed with a spigot 16 and end 12 is formed with a complementary receptacle 18. The portion of the band 10 from end 12 to point X and from end 14 to point Y is made curved to a first internal radius R that corresponds to the nominal external radius of the stabilised joint. The intermediate portion X-Y of the band is made to a larger radius R', so that in the relaxed state of the band a gap exists between the ends 12, 14. The total length of the band measured along the inner face and excluding the spigot 16 corresponds to the nominal minimum circumference of the stabilised joint. When the band 10 is crimped onto the joint to lock the ends 12, 14 together (as further described below) the portion X-Y is subjected to bending strain from radius R' to radius R, as well as to hoop strain necessary for its joint stabilising and seal energising function; whereas the two end portions beyond X, Y are subject only to the hoop strain and no bending strain. During the crimping operation, the spigot 16 is inserted into the receptacle 18 as far as it will go, to bring the ends 12, 14 close together and to close or narrow the gap between them, as shown in FIG. 2.

As shown in FIG. 3, the spigot 16 is provided with a series of ratchet teeth 20 on its inner face. The teeth are asymmetric, each having a sloping lead-in flank 22 and a locking flank 24. This locking flank faces rearwardly of the spigot 16 and lies substantially in a radial plane of the band 10 (or even at a "backward" rake angle, not shown). As seen in FIGS. 4-7, the receptacle 18 has a complementary series of ratchet teeth 26 formed on its radially inner wall, again with sloping lead in flanks 22 and radially oriented locking flanks 24 (or at a backward rake angle to match that of the locking flanks of teeth 20) facing rearwardly into the receptacle 18. As the spigot 16 is driven into the receptacle 18 during crimping of the band 10, the lead-in flanks 22 of the teeth 20, 26 slide over one another, elastically deforming the walls of the receptacle 18 and forcing them radially apart. The radial walls of the receptacle 18 are however linked together by a top wall 28 and a lower cross brace 30. Various apertures are defined in the top wall 28 and on either side of the brace 30, allowing access for mould cores used to form the receptacle and its internal teeth 26. The locking flanks 24 on the teeth 20, 26 periodically drop one behind another in a series of "clicks", until the locking flanks 24 on all (or sufficient) of the teeth 20, 26 are interengaged, holding the band ends 12, 14 adjacent to one another and preventing these ends from disengaging. For the elastic deformation of the receptacle 18 radial walls to be sufficient to allow the lead-in flanks 22 of the teeth 20, 26 to slide past one another, the teeth 20 do not extend the full width of the spigot 16, as best seen in FIG. 3. Additionally or alternatively, the teeth 26 can extend less than the full height of the receptacle 18. When tension is applied to the band 10, the interengaged locking flanks do not slide relative to one another, as their radial orientation (normal to the circumferential tensile force) provides no wedging action. A backward rake means that applied tension will cause the teeth 20, 22 to interlock more tightly. The band will therefore break (e.g. at the weak point where the spigot 16 joins the band end 14) before the spigot disengages from the receptacle 18, providing clear evidence of tampering if an attempt is made to forcibly remove the band 10 e.g. from around a container spout/neck joint. The region of the spigot 16 where it joins the band end 14 may be deliberately weakened, e.g. notched, accordingly.

Figure 8:
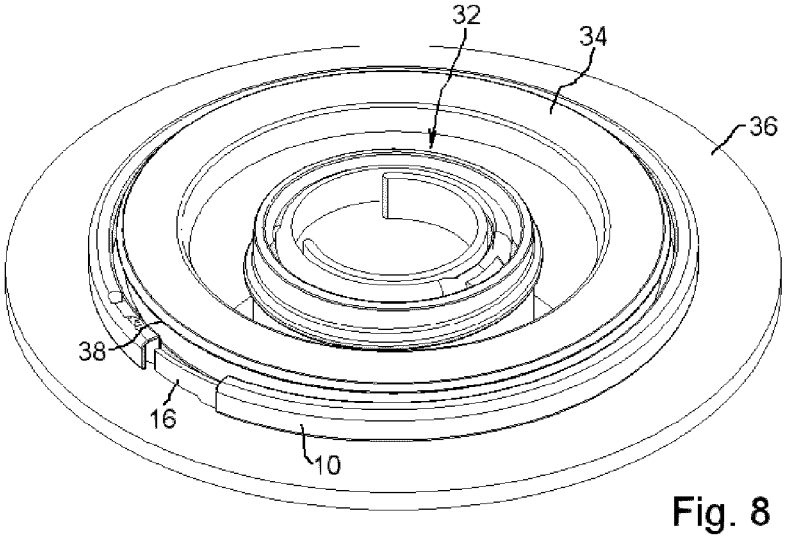
FIGS. 8 and 9 show the band of FIG. 1 placed around a container neck/pouring spout joint, in the open and closed condition respectively.
Figure 9:
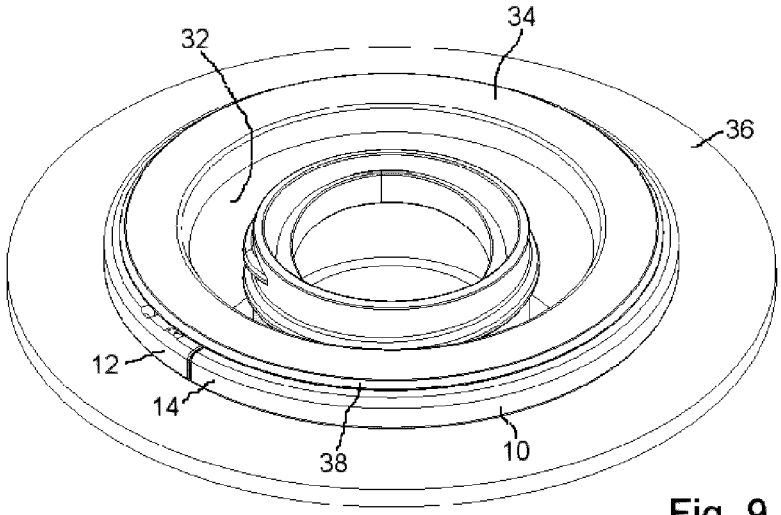
Figure 10:
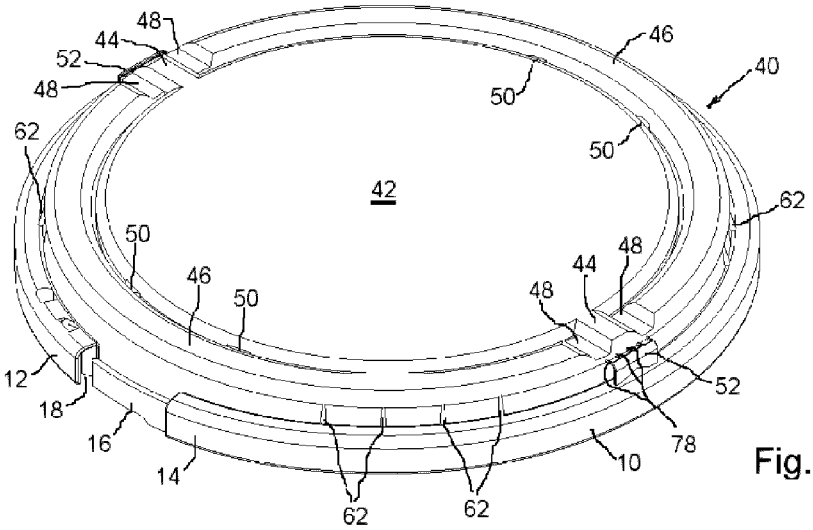
FIGS. 10 and 11 are perspective views respectively showing the top and bottom of a cap incorporating a joint stabilising band in accordance with an embodiment of the present invention.

FIG. 8 shows a nestable/extendable flexible plastics pouring spout 32 having an inverted U-profiled sealing and securing lip 34 fitted over an upstanding neck (not visible) surrounding a filling opening in a container top such as a pail lid 36. The uncrimped, open or expanded stabilising band 10 is placed loosely around the outside of the sealing and securing lip 34 for engagement by a standard crimping tool as is commonly used to apply metal stabilising crimp rings to a container/spout joint. Actuation of the crimping tool drives the spigot 16 into the receptacle 18 to close and lock the band ends 12, 14 together, as described above. The band 10 is thereby trapped beneath a projecting shoulder 38 formed on the sealing and securing lip 34 (see FIG. 9). The interaction between the stabilising band 10, the sealing and securing lip 34 and the container neck so as to form a stable and leak-proof joint, is further described below with reference to FIGS. 14 and 15. When the spigot 16 is inserted into the receptacle 18 as far as necessary to crimp the band tightly around the container spout/neck joint or any other required container location, the spigot and receptacle are firmly supported, with the interengaged teeth 20, 26 disposed in a concealed, radially inward position, in which it is very difficult if not impossible to gain access to them with a screwdriver or similar implement in an attempt to lever them out of engagement. Any such tampering attempt is likely to result in visible damage to the joined band ends.

FIGS. 10-15 show a further embodiment of the invention in which the stabilising band 10 is integrally formed (preferably injection moulded) as part of a container closure cap 40. The band 10 shown in FIGS. 10-15 is otherwise similar to that shown in FIGS. 1-9. The cap 40 has a circular, disk-like top wall 42 provided with a pair of projecting ears 44 arranged at opposite ends of a diameter. A pair of bail handles 46 are hingedly attached to sides of the ears 44 by flexible webs 48. The bail handles 46 are also connected to the rim of the top wall 42 by frangible links 50 which help to keep the handles properly stowed during storage and transit of the cap prior to opening by the end user. These frangible links therefore also provide a degree of tamper indication. Further frangible connecting arms 52 extend from the outer ends of the ears 44 downwardly to the stabilising band 10. As the stabilising band 10 is firmly secured about the spout-to-container joint (more particularly, secured beneath the shoulder 38 on the spout peripheral sealing and securing lip 34) when fully fitted with its ends 12, 14 crimped closed, the spout 32 cannot be raised nor the cap 40 removed without breaking the frangible connection arms 52. These therefore provide a further tamper indicating security feature. The arms 52 are shaped and oriented so as to be resistant to axial force, thereby constraining the spout and cap against "pop-up", e.g. under the influence of higher than ambient pressure within the container. The arms are however designed to shear off from the band 10 and/or ears 44 as the cap is initially slightly unscrewed from the spout, thereby allowing the spout to be pulled out and the cap to be fully unscrewed (minus the securing band 10, which is left crimped around the container/spout joint).

Figure 11:
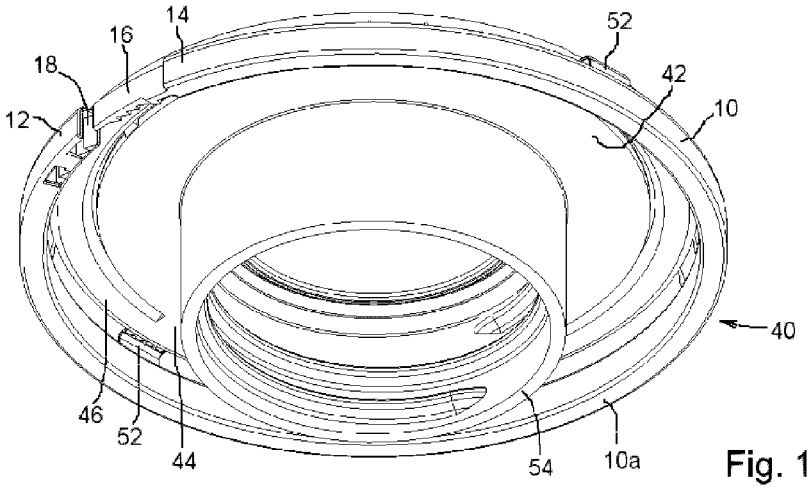
Figure 12:
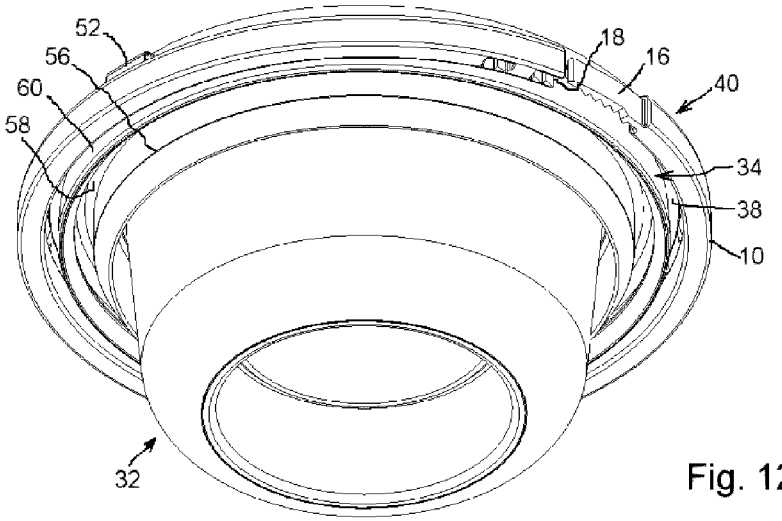
FIGS. 12 and 13 correspond to FIGS. 10 and 11 respectively but show the cap fitted to a spout prior to mounting the spout on a container.
Figure 13:
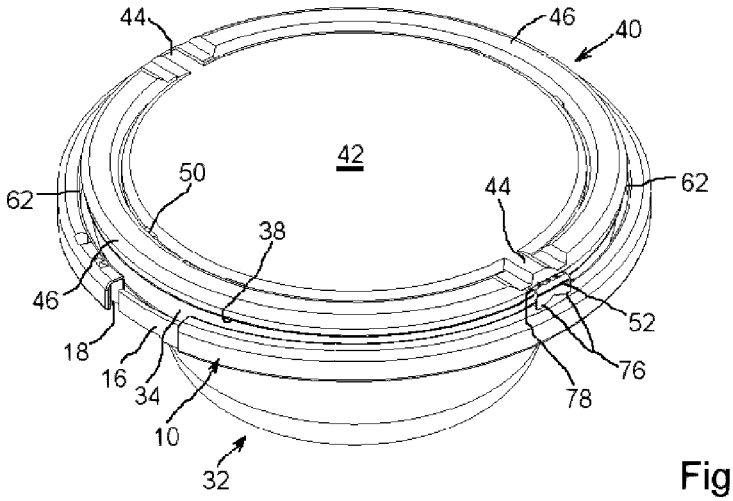

As best seen in FIG. 11, the cap 40 comprises an internally threaded collar 54 depending from the top wall 42. The collar 54 can be screwed onto the externally threaded tip of the flexible spout to form a subassembly (see FIG. 12) for supply to a customer for use on a container filling line. During fitment to the container at the filling line, the subassembly is initially applied to the container so that the sealing and securing lip 34 is seated on the container neck. With the subassembly in this position, the open, expanded or unlocked stabilising band 10 is initially disposed loosely about the outer circumference of the spout sealing and securing lip 34, in the correct position for trapped reception beneath the shoulder 38 once the crimping operation has been completed. It can also be seen in FIG. 12 that the inverted U-shaped profile of the spout sealing and securing lip comprises an inner sealing wall 56, a top wall 58 and an outer sealing wall 60. To help to maintain the open band 10 in the correct position in the subassembly prior to the crimping operation (e.g. during storage of the subassembly and shipment to the filling line customer), further frangible plastics links 62 are provided between the band 10 and the bail handles 46 (see FIG. 10). In this embodiment these are broken during the crimping operation, although other arrangements are possible, an example of which is described below with reference to FIGS. 26-32, in which similar frangible connections remain intact after the crimping operation.

Figure 14:
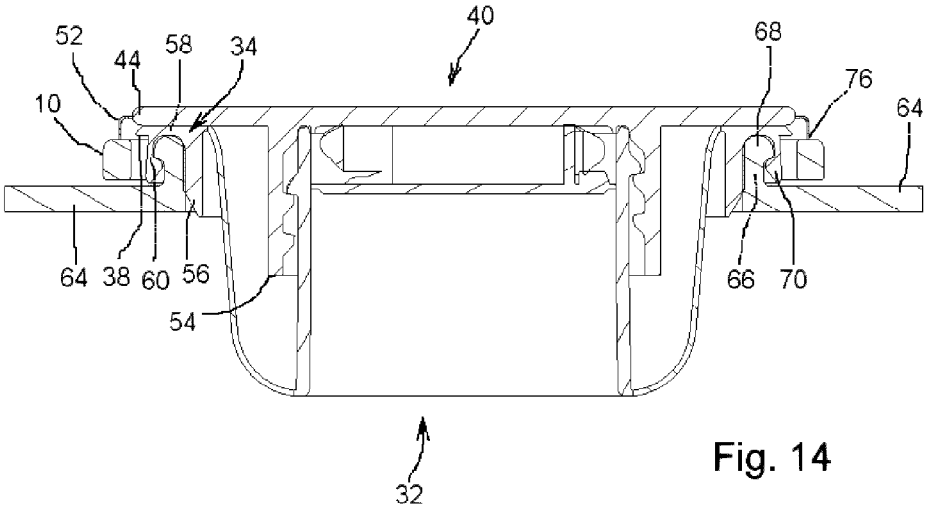
FIG. 14 is a cross-sectional view corresponding to FIGS. 12 and 13, but also showing the cap and spout assembly placed in a container filling/dispensing opening, prior to constriction of the stabilising band.

FIG. 14 shows the cap and spout subassembly 40, 32 seated in an opening in a pail lid, can or drum end or like container wall 64, prior to constriction of the band 10 by crimping its ends 12, 14 into fastened engagement. The container opening is surrounded by an upstanding neck 66 having an outwardly directed peripheral rib 68. An inwardly directed peripheral rib 70 on outer sealing wall 60 of the spout sealing and securing lip 34 snaps beneath the neck peripheral rib 68. The inner sealing wall 56 of the spout sealing and securing lip seats inside the neck 66. As the material of the spout 32 is flexible, with the stabilising band 10 in its open, expanded and unfastened condition, the snap-fit of the outer sealing wall 60 over the neck 66 does not provide a mechanically strong or reliably leak-proof joint between the spout 32 and the container neck 66. In the open condition shown in FIG. 14, the band 10 is a clearance fit over the shoulder 38. Indeed its open ends 12, 14 and the flexibility in the links 62 and arms 52 allow the band 10 to be flexed further open if necessary, to pass over the shoulder 38.

Figure 15:
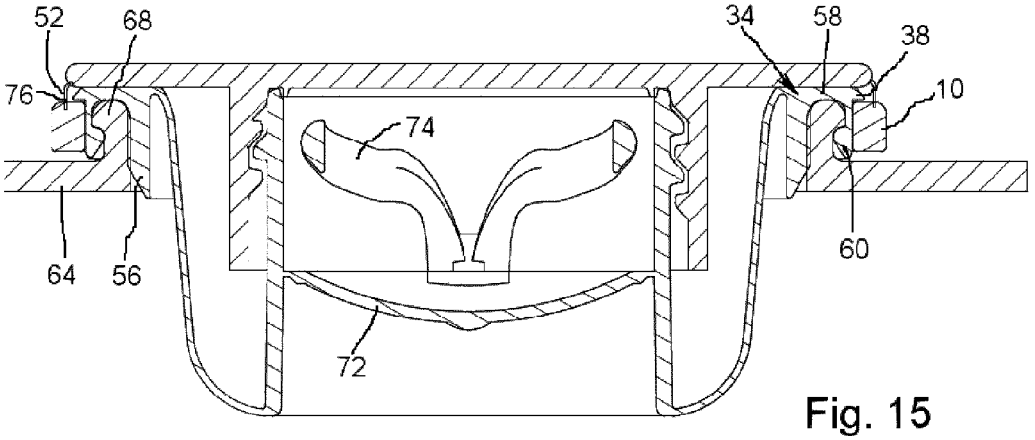
FIG. 15 corresponds to FIG. 14 but shows the band crimped, constricted and locked.

FIG. 15 generally corresponds to FIG. 14, but shows the securing band 10 in the crimped, closed and constricted condition. It also shows a different style of tear-out membrane 72 and pull ring 74 compared to the corresponding parts shown in FIG. 14 (as do FIGS. 8 and 9). As the band 10 is crimped closed, the arms 52 flex inwardly and the frangible links 62 are broken. When the ends 12, 14 of the band 10 are locked together with the spigot 16 fully inserted into the receptacle 18 (in similar manner to what is shown in FIGS. 2, 5, 6, 7 and 9), the band 10 is tightly constricted around the spout sealing and securing lip 34 and is trapped between the shoulder 38 and the container wall 64. As the band 10 is crimped tight, the top wall 58 and an outer sealing wall 60 of the spout sealing and securing lip 34 are progressively wrapped around and brought into intimate sealing contact with the rib 68 at the distal end of the neck 66, to form a reliable fluid tight seal, despite the possible wide variation in the diameter and profile of the rib 68. The band 10 also prevents expansion of the rib 70 on outer sealing wall 60 of the spout sealing and securing lip 34 and therefore locks the ribs 68, 70 together. The support band 10 therefore also serves to form a strong mechanical connection between the container and the pouring spout 32, once the band 10 has been crimped in position beneath the shoulder 38, tightly about the spout sealing and securing lip 34.

In this embodiment, after the band has been crimped in this way, the arms 52 remain connected between the ears 44 and the band 10. They therefore act to prevent the cap 40 and spout 32 from popping up under the influence of raised pressure within the container. Raising the bails 46 by rotating them about their hinges 48 breaks the links 50 and provides a pair of handles by which the cap can be unscrewed from the end of the spout 32. Unscrewing the cap by a few degrees shears thinned web portions 76 at the base of the arms 52, as the band 10 remains fixedly clamped about the spout sealing and securing lip 34. The cap central portion (i.e. the remainder of the cap 44) thereby becomes detached from the band 10 and can be pulled out together with the spout 32. When the spout 32 has been fully extended, the central part of the cap can be fully unscrewed to open the spout and allow the container contents to be dispensed, after removal of the tear-out membrane 72, if necessary. The arms 52 and their frangible web portions 76 therefore provide a further tamper-indicating security feature.

As the ends 12, 14 of the band 10 are crimped together to tighten the band 10 about the spout sealing and securing lip 34, the arms 52 will move relative to the cap 44 central portion in the circumferential direction towards the band ends 12, 14. The arms 52 are therefore provided with flexible linkages 78 (see FIGS. 10 and 13) to accommodate this movement. The length of the band internal surface between the centres of the arms 52 may be chosen to be equal to the outer semi-circumference of the spout sealing and securing lip 34 when fully fitted to a container neck 66 which has an outer diameter midway between the largest and smallest sizes encountered in practice, so as to minimise the arm 52 circumferential movement.

Alternatively, the continuous portion 10*a* of the band 10 (see FIG. 11) extending between the arms 52 opposite to the portion of the band which is interrupted to form the ends 12, 14 is modified to contain a similar interruption, thereby forming a further pair of similar ends with a detent comprising parts that are mechanically interengageable, e.g. similar or identical to the spigot and socket shown in FIG. 11. Preferably the closing movement required to secure each set of ends together in its fully constricted position is substantially the same, so that there is little or no circumferential movement of the band 10 relative to the cap central portion at the arms 52 as the band is crimped into its final position, substantially continuously and completely encircling and gripping the spout sealing and securing lip 34. More than two such interruptions (and hence corresponding pairs of ends) may be provided in the band 10. This applies to any of the bands described above or below, including but not limited to that shown in FIGS. 1-9. Rather than consisting of a single segment with interengageable ends, the retaining band may thus comprise a plurality of interengageable segments.

Figure 16:
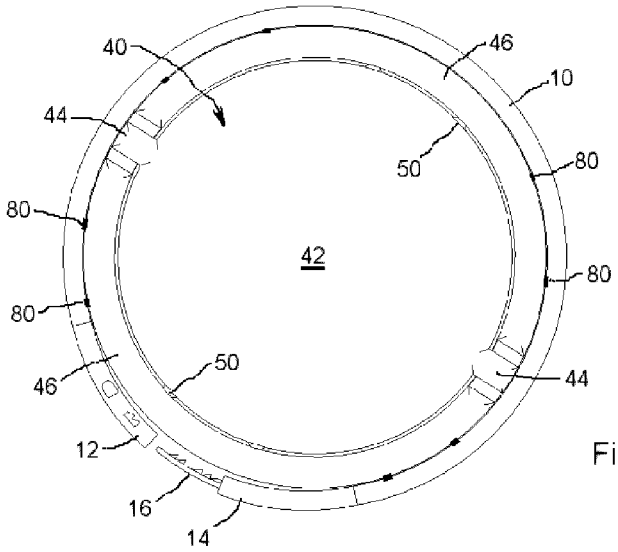
FIGS. 16-18 are top, side and perspective views of another embodiment of a cap and stabilising band.
Figure 17:
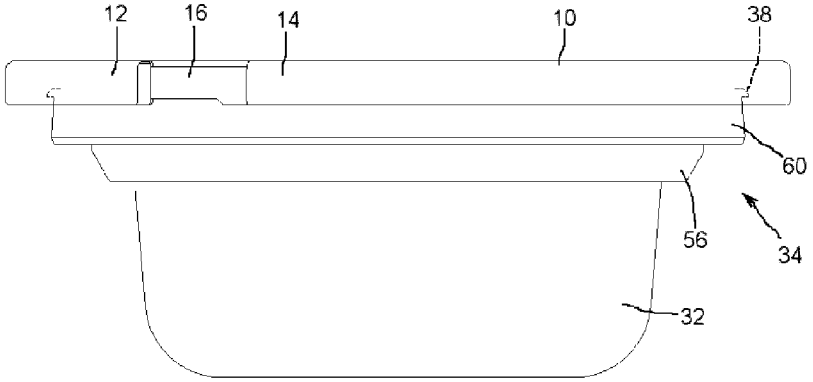
Figure 18:
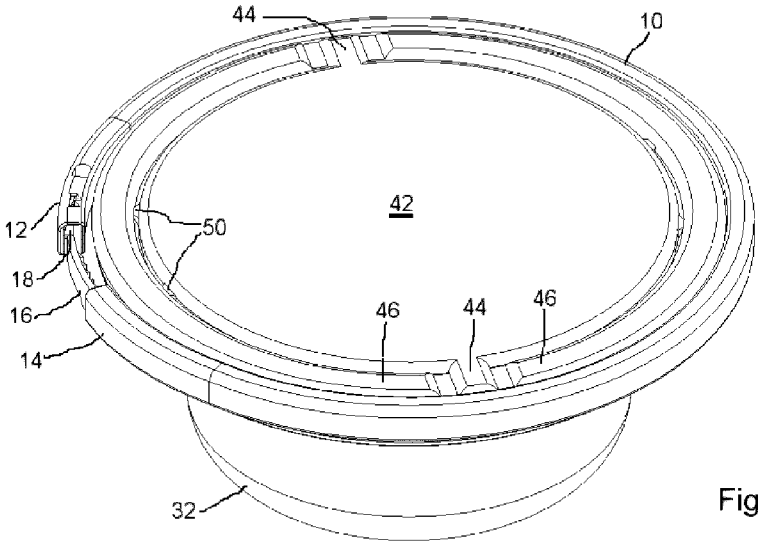

FIGS. 16-18 show a further container cap 40 and spout 32 assembly with an integrally formed restraining band 10, which is generally similar to the assembly shown in FIGS. 10-15 (including the possible modifications described above), but which is somewhat simplified, so as to eliminate the connecting arms 52. Prior to installation of the cap and spout assembly on a container neck 66, the restraining band 10 lies above its final, constricted, fully installed position below the shoulder 38 in clamping co-operation with the outer sealing wall 60 of the spout sealing and securing lip 34. Instead, as best seen in FIG. 17, the band 10 initially surrounds the shoulder 38, which is therefore hidden and so is shown in dotted lines. The band 10 is connected to the bail handles 46 by frangible links 80. As shown, the top surface of the band 10 lies substantially flush with the top surfaces of the bail handles 46, and with the top surface of the cap top wall 42. However, other positions for the band 10 are possible, which likewise allow it to be connected to the bail handles 46 and/or the ears 44 by relatively simple frangible links.

In use, the cap and spout subassembly is seated on the container neck by means of the spout sealing and securing lip 34. A crimping tool is then moved downwardly over the restraining band 10, breaking the frangible links 80. The band 10 is thereby disconnected from the remainder of the cap 40 and carried downwardly into registration adjacent to the outer sealing wall 60 of the sealing and securing lip 34, below the shoulder 38. Continued actuation of the crimping tool then closes and constricts the band 10, tightly clamping it about the outer sealing wall 60. Thus the ends 12, 14 of the retaining band 10 are locked together so as to close up or reduce the gap therebetween, as is also the case for all the other bands described above. A standard crimping tool as used to apply metal crimp rings to container/spout joints may be used for this purpose. Alternatively, the band may have protrusions, recesses or other graspable formations adjacent to its ends, engageable by a pincer-like crimping tool. Such an arrangement may be particularly suitable for longer bands as used for example to secure removable lids to drums, pails and similar containers.

FIGS. 19-25 show a further cap 40 embodying the present invention, and which is generally similar to the caps described above with reference to FIG. 10 or 16, but differing in the following features. These different features may be substituted for or used in combination with the corresponding features described above, either individually or in any compatible combination.

The spigot 16 is connected to the outer side wall at the mouth of the receptacle 18 by a frangible web 90. This web is broken as the band 10 is crimped closed and the spigot 16 driven into the receptacle 18, but prior to this helps to hold the band ends 12, 14 in the correct relative position.

Figure 23:
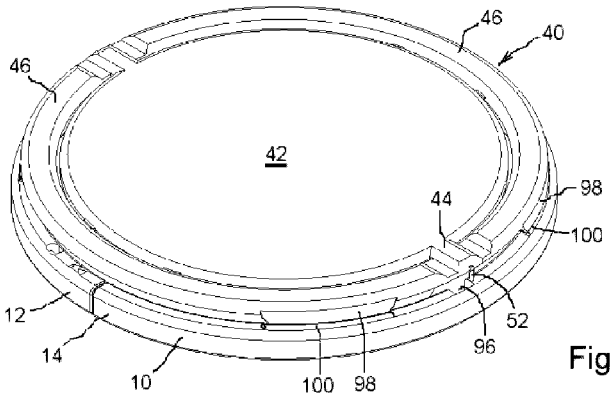
FIGS. 23 and 24 correspond to FIGS. 19 and 20, but show the band in its closed, constricted condition, rather than open.
Figure 24:
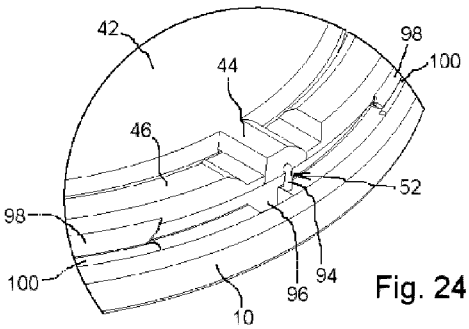

As shown in FIGS. 19, 20, 23, 24 and 25, the connecting arms 52 are rod-like and generally L shaped, having a first, shorter part 92 extending substantially radially from the end of the corresponding ear 44 and a second, longer part 94 running from the radially outer end of the shorter part 92 to the band 10, at an angle sloping downwardly and away from the gap between the band ends 12, 14. The band 10 includes cutaway portions 96 providing vertical access to mould cores (not shown) used in forming the connecting arms 52. As seen in FIGS. 23 and 24, as the band ends 12, 14 are fastened together, the connecting arms twist or distort about their first, shorter parts 92, so that their second, longer parts 94 lie more vertically, thereby accommodating the circumferential movement of the band 10 as it constricts.

Figure 19:
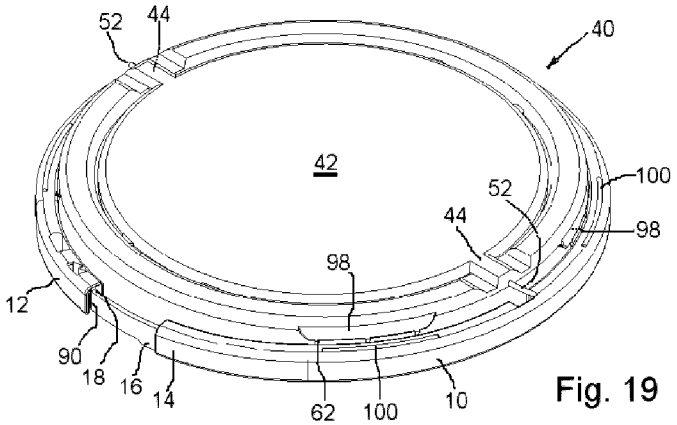
FIG. 19 is a top perspective view of a further embodiment of a cap and stabilising band of the invention.
Figure 20:
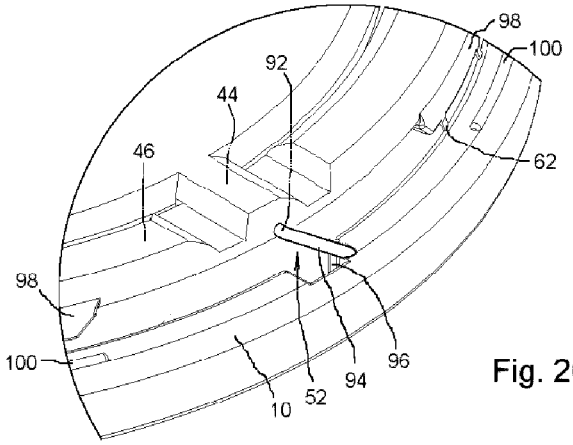
FIG. 20 is a more detailed view of a portion of FIG. 19.
Figure 21:
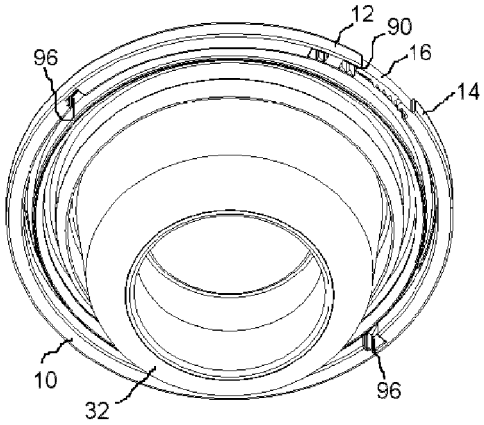
FIG. 21 is a perspective view from below of the cap of FIG. 19 assembled together with a flexible plastics spout, prior to installation on a container neck.
Figure 22:
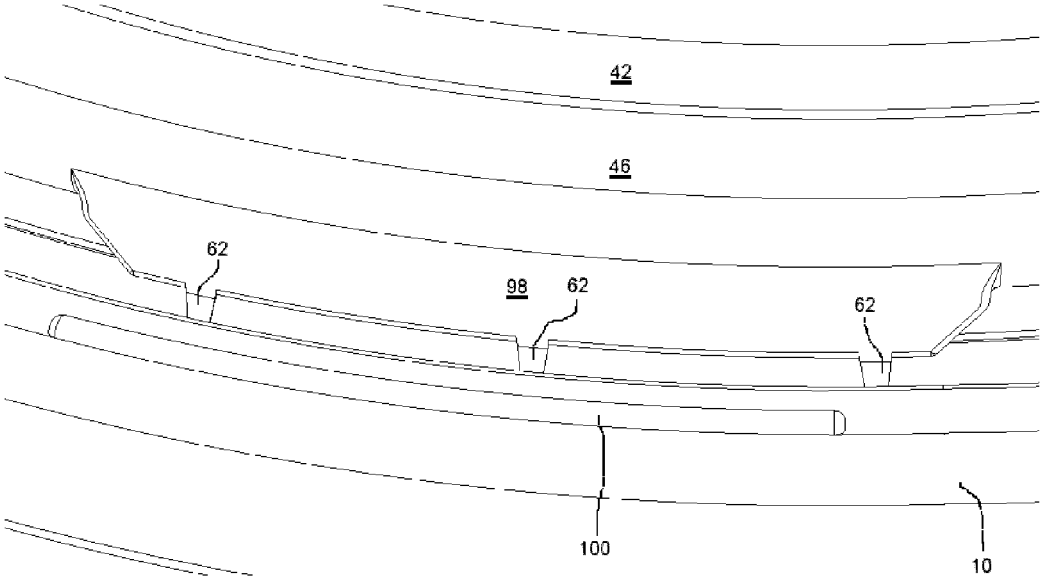
FIG. 22 is a detail view of a frangible link between the band and a bail handle in the cap of FIG. 19.

Referring to FIGS. 19, 20 and 22, the frangible plastics links 62 extend between the band 10 and the free lower edges of somewhat flexible tabs 98 which extend outwardly and downwardly from the bail handles 46. Shielding ridges 100 are formed on the top surface of the band 10, at positions radially corresponding to the tabs 98. The links 92 break as the ends 12, 14 are crimped together to constrict the band 10, as shown in FIGS. 23 and 24. The shielding ridges 100 are brought into contact with the free ends of the tabs 98 by constriction of the band 10; the tabs 98 being flexed inwardly by a variable amount commensurate with the degree of constriction of the band 10. The contact between the shielding ridges 100 and the tabs 98 hides the broken ends of the frangible links 62, so that the end user of the closure cap 40 is not falsely alarmed into believing that unauthorised tampering has taken place.

Figure 25:
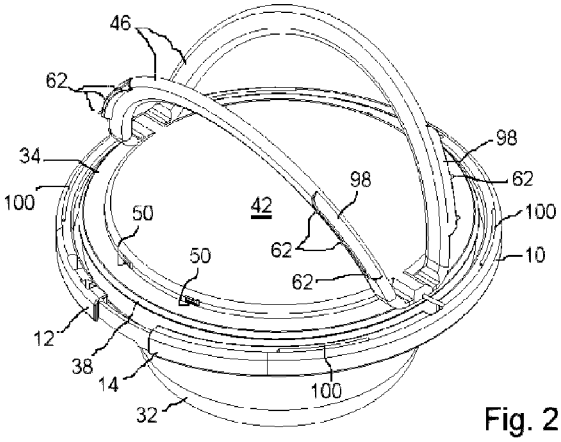
FIG. 25 shows the cap of FIG. 19 with its bail handles raised.

Referring now to FIG. 25, the bail handles 46 are shown raised, thereby breaking the frangible links 50. For illustrative purposes only, the band 10 is shown in its open, unconstricted condition, with the ends 12, 14 unfastened. Normally however, the closure cap 40 and spout 32 assembly will be fully fitted to a container with the band 10 crimped closed, before the bail handles 46 are raised by an end user, to open the container for the first time. The tabs 98 and the broken frangible links 62 are positioned towards the ends of the bail handles 46, leaving a smooth centre section which is comfortable for the end user to hold.

Although a particular form of detent has been described in detail above, in which a toothed spigot on one end of the band is engageable in a complementary toothed receptacle on another end of the band, any other suitable detents can be used having mechanically interengageable parts which serve to prevent movement of the band from the constricted position towards the expanded position. Detents are preferred which are destroyed or visibly damaged upon re-opening, so as to provide a tamper indicating security function. Although the band has been described above as performing a joint constraining and/or stabilising function, it may also serve other purposes, e.g. simply to retain a closure on a container. Detents requiring destruction for removal of the band again provide tamper indication, but are again optional.

FIGS. 26-32 show a further container spout 32 and cap 40 subassembly with an integrally formed restraining band 10, which is generally similar to the other subassemblies described above (including their possible modifications, where compatible), but with the following differences. Like references are used throughout the description to refer to like parts.

As best seen in FIG. 26, a pair of spigots 16 is provided at diametrically opposite positions in the band 10 for cooperation with a pair of receptacles 18. The band is therefore divided into two interengageable segments, 10*a*, 10*b*. As illustrated, the band discontinuities formed by the spigots and receptacles lie close to the bail handle attachment ears 44, although they can in principle lie at any circumferential (preferably diametrically opposed) positions in the band 10. Each spigot 16 is again connected to the mouth of the corresponding receptacle 18 by a frangible web 90 (this time connected to the upper side wall of the receptacle: see FIG. 29). The ratchet teeth 20 are provided on a surface of the spigot 18 which lies towards the lower circumferential surface of the retaining band 10; although the teeth 20 could also be provided on the opposite surface of the spigot which faces upwardly. Indeed, when this configuration of ratchet teeth is used in a separate joint stabilising band as shown in FIGS. 1 and 2, the band can be applied to the joint either way up. The lower surface is the preferred location for the teeth 20 as this usually provides better security, as further explained below. Only a single spigot and receptacle may be provided in the band, or more than two sets of spigots and receptacles may be present to divide the band into more than two interengageable segments. The teeth 20 on the spigot(s) 16 co-operate with teeth 26 formed on a resiliently biased pawl 102 extending into the receptacle 18. One side of the receptacle 18 is generally open, apart from a bridging piece 104 which extends across the width of the receptacle 18 on that side. The pawl 102 is integrally moulded with the bridging piece and is bent outwardly, placing the bridging piece 102 under torsion, as the spigot 16 is inserted into the receptacle 18. The teeth 20, 26 ride over one another as the spigot is inserted into the receptacle, the pawl clicking outwardly and then springing inward again as the teeth pass one another. However, attempting to withdraw the spigot 16 from the receptacle 18 causes the teeth 20, 26 to bind against each other, tending to rotate the pawl 102 into even tighter engagement with the spigot 16. The spigot is therefore locked in the receptacle 18. With the spigot 16 fully inserted into the receptacle 18 and the stabilising band firmly fixed in place adjacent to a container wall, the teeth 20, 26 and the pawl 102 are inaccessible to tools such as a screwdriver and therefore cannot easily be prized open.

The arms 52 connecting the bail handle attachment ears 44 to the band 10 comprise a first portion 108 extending generally radially outwardly of the corresponding ear 44, a second portion 110 extending generally circumferentially of the closure cap from the outer end of the first portion, and a third portion 112 extending downwardly and outwardly from the distal end of the second portion and connected to the band 10. More specifically, the lower end of the third portion 112 is connected to the band end 14: see FIGS. 28 and 31. As the band is crimped into position beneath the shoulder 38 and against the outer wall 60 of the spout sealing and securing lip 34, the second portion 110 is free to rotate downwardly and the third portion 112 of the arm 52 is free to rotate inwardly, to the extent necessary to allow the band to be fully crimped against and tightened about the outer wall 60. The connecting arms 52 are not broken in this process and act as extensible links between the band and 10 the closure cap 40 which maintain the band in the correct relative position for the start of the crimping process.

The links 62 provided between the band 10 and the bail handles 46 may take substantially exactly the same form as the arms 52, so the one is indistinguishable from the other, apart from the arms 52 being located at the ears 44. The connections so formed may be placed at any point around the periphery of the bail handles 46, so long as the band 10 is supported in a suitable position to start the crimping operation, when the cap and spout subassembly has been placed in position with the spout sealing and securing lip 34 in engagement with the container neck 66. Thus the connections 52 to the ears 44 are optional. The connections 52/62 are preferably fairly evenly spaced about the circumference of the band 10 so the band parts are evenly supported; although a larger gap between connections may be left at the centre portions of the bail handles to assist in rupturing the connections when it is desired to lift the bail handles for the first time. The lower edge of each bail handle 46 may be scalloped at its centre section 106 to provide finger access for lifting the handle and rupturing the connections 62.

Prior to lifting the handles and with the band crimped in place, the connections 52/62 will evenly share the load of any overpressure in the container, preventing the cap centre section from popping up beyond the slight range of movement allowed for by straightening of the connections 52/62. Their extensible nature moreover allows some degree of freedom for the band to move up or down during fitment, to suit different container opening heights and also allows the different segments of the band to be crimped together without fracturing the connections 52/62. The flexibility of the connections provides little resistance to the radially inwardly directed forces applied by the crimping tool.

Raising the bail handles 46 breaks all the connections (62), apart from any (52) at the bail handle attachment ears 44. Once the latter connections 52 are broken by pulling upwardly on or twisting the cap inner part using the bail handles, the cap and spout can be pulled out leaving the band 10 behind, and the cap can be unscrewed from the end of the spout.

Figure 32:
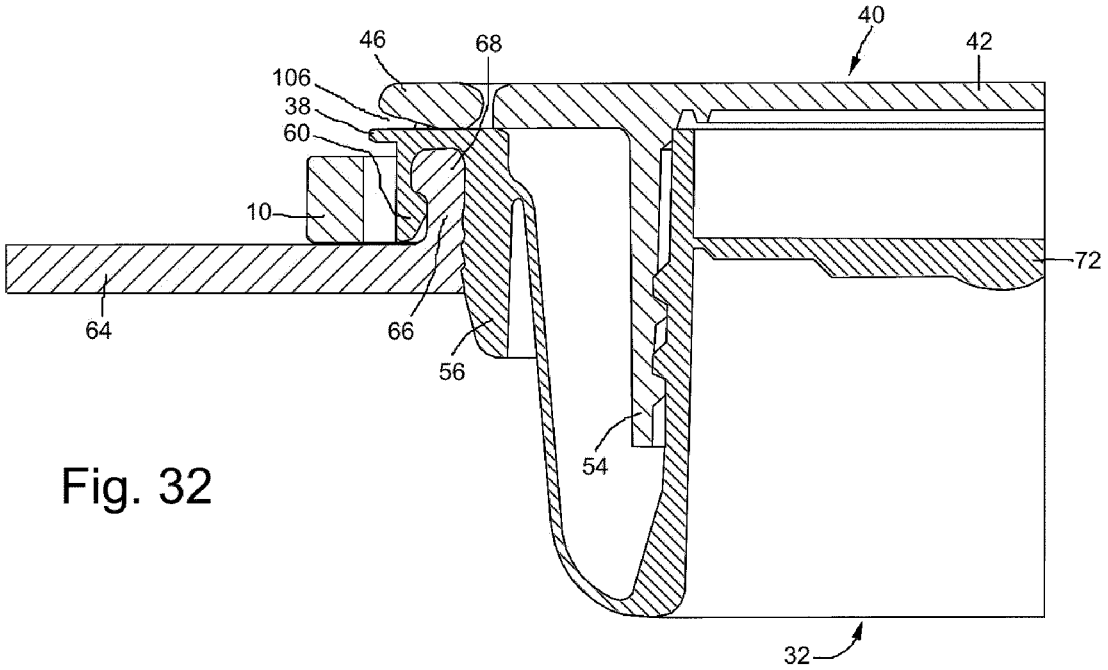
FIG. 32 is a cross-sectional view showing in part the cap and stabilising band of FIG. 26 fitted to a pail lid.

To help to maintain the band 10, sealing and securing lip 34, and bail handles 46/ears 44 in the correct relative positions prior to installation of the cap/spout subassembly on a container, the band 10 has a number of circumferentially spaced detents 114 projecting radially inwards from its upper inner edge. On assembly of the cap 40 and spout 32, the sealing and securing lip shoulder 38 is snapped into position, between the detents 114 below and the bail handles/ears above. The detents 114 are thin, e.g. 0.008 inches (0.2 mm) thick. When the band 10 is crimped into place about the container neck/spout joint, the detents buckle and rotate downwardly so they are invisible in the final assembly of the cap and spout on the container and do not interfere with the substantially even constriction of the band about the spout/container joint. FIG. 32 shows the cap/spout subassembly fully installed in an aperture in a container wall 64 surrounded by a short upstanding neck 66, with the band 10 crimped into its constricted configuration.

Figure 33:
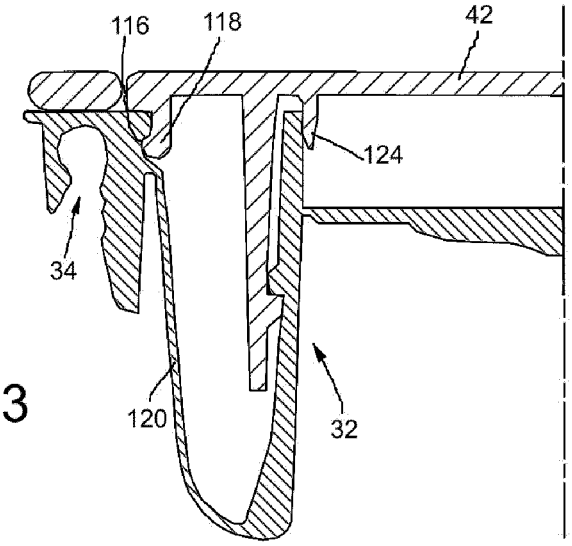
FIG. 33 shows some further modifications to the cap/spout subassembly.

FIG. 33 shows some further optional modifications to the cap and spout. A deeper land may be provided within the upper interior of the sealing and securing lip 34 above the junction with the flexible wall 120 of the spout 32, to accommodate an anti-pop-up retaining groove 116. A lip depending from the periphery of the cap top 42 has a radially outwardly directed bead 118 which snap-fits into the groove 116 to help prevent the cap centre part and spout from lifting due to container internal pressure, e.g. after the cap has been opened by an end user and the connections 52/62 broken. A secondary lip seal 124 is shown depending from the cap top 42 to help bias the cap/spout threads (and/or the cooperating unthreaded, e.g. wedge tapered, portions of the spout tip and cap collar 54) into interference.

The invention claimed is:

1. A container comprising a ring-shaped retaining band, the ring-shaped retaining band comprising:
- a circumferential interruption;
- a first end;
- a second end which faces the first end in the circumferential direction of the ring-shaped retaining band, across the circumferential interruption; and
- a detent comprising a spigot mechanically engageable in a receptacle, wherein:
  - the spigot has a length extending outwardly from the first end, circumferentially of the ring-shaped retaining band, and has an outer surface provided with at least a first ratchet tooth,
  - the receptacle extends inwardly from the second end, circumferentially into the ring-shaped retaining band, is shaped and positioned for reception of the spigot, and has an inner surface provided with at least a second ratchet tooth,
  - the ring-shaped retaining band is integrally formed as part of a container,
  - the ring-shaped retaining band is movable from an expanded position where the spigot is driven into the receptacle in a direction circumferentially of the band, to mechanically engage in the receptacle in a constricted position, and
  - when the spigot is mechanicaly engaged, movement of the ring-shaped retaining band from the constricted position towards the expanded position is prevented by interengagement of the first ratchet tooth with the second ratchet tooth, which are each then disposed in a concealed position within the receptacle, whereby they are protected against being levered out of engagement.

2. The ring-shaped retaining band of claim 1, wherein the ring-shaped retaining band comprises a recessed cross-sectional profile.

3. The ring-shaped retaining band of claim 1, wherein the ring-shaped retaining band is made entirely of plastics.

4. The ring-shaped retaining band of claim 1, wherein the first ratchet tooth and the second ratchet tooth have to be destroyed or visibly damaged to permit removal of the fully fitted ring-shaped retaining band from a container.

5. The ring-shaped retaining band of claim 1, further comprising a plurality of interengageable segments.

6. The ring-shaped retaining band of claim 1, further comprising a plurality of the first ratchet teeth.

7. The ring-shaped retaining band of claim 1, further comprising a plurality of the second ratchet teeth.

8. The ring-shaped retaining band of claim 1, wherein the ring-shaped retaining band is tightly engageable about a container by the interengagement of the first and second ratchet teeth.

9. A container closure comprising a ring-shaped retaining band, the ring-shaped retaining band comprising:

a circumferential interruption;

a first end;

a second end which faces the first end in the circumferential direction of the ring-shaped retaining band, across the circumferential interruption; and a detent comprising a spigot mechanically engageable in a receptacle, wherein:

the spigot has a length extending outwardly from the first end, circumferentially of the ring-shaped retaining band, and has an outer surface provided with at least a first ratchet tooth, the receptacle extends inwardly from the second end, circumferentially into the ring-shaped retaining band, is shaped and positioned for reception of the spigot, and has an inner surface provided with at least a second ratchet tooth, the ring-shaped retaining band is integrally formed as part of the container closure, the ring-shaped retaining band is movable from an expanded position where the spigot is driven into the receptacle in a direction circumferentially of the band, to mechanically engage in the receptacle in a constricted position, and when the spigot is mechanicaly engaged, movement of the ring-shaped retaining band from the constricted position towards the expanded position is prevented by interengagement of the first ratchet tooth with the second ratchet tooth, which are each then disposed in a concealed position within the receptacle, whereby they are protected against being levered out of engagement.

10. The container closure of claim 9, wherein the container closure further comprises a central part mountable on a pouring spout to close the pouring spout.

11. The container closure of claim 10, wherein the container closure comprises one or more movable bail handles.

12. The container closure of claim 11, wherein the one or more movable bail handles are attached to the central part by a frangible connection.

13. The container closure of claim 11, wherein the one or more movable bail handles are attached to the ring-shaped retaining band by a frangible connection.

14. The container closure of claim 10, wherein the central part is connected to the ring-shaped retaining band by a frangible connection.

15. The container closure of claim 10, wherein the ring-shaped retaining band is connected to the remainder of the container closure by a frangible connection.

16. The container closure of claim 15, wherein the frangible connection is broken and is hidden from view on interengagement of the first and second ratchet teeth.

17. The container closure of claim 15, wherein the frangible connection is extensible to remain unbroken when the first and second ratchet teeth are interengaged.

* * * * *